US011041285B2

(12) United States Patent
Johnson et al.

(10) Patent No.: US 11,041,285 B2
(45) **Date of Patent: *Jun. 22, 2021**

(54) MACHINE WITH A BOOM ASSEMBLY

(71) Applicant: Caterpillar Inc., Peoria, IL (US)

(72) Inventors: Terril James Johnson, Washington, IL (US); David Eugene Cooper, Chillicothe, IL (US); Anthony Dean McNealy, Dunlap, IL (US); Matthew Bunge, Rapid City, SD (US); Andrew Sumners, Box Elder, SD (US); Rustin Glenn Metzger, Congerville, IL (US); Corey Lee Gorman, Peoria, IL (US); Brad Robert Van De Veer, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/682,425

(22) Filed: Nov. 13, 2019

(65) Prior Publication Data

US 2020/0102716 A1 Apr. 2, 2020

Related U.S. Application Data

(63) Continuation of application No. 15/956,324, filed on Apr. 18, 2018, now Pat. No. 10,508,409.

(51) Int. Cl.

| | |
|---|---|
| ***E02F 3/38*** | (2006.01) |
| ***E02F 3/30*** | (2006.01) |
| ***E02F 3/32*** | (2006.01) |
| ***E02F 9/16*** | (2006.01) |
| ***E02F 3/34*** | (2006.01) |
| ***E02F 3/358*** | (2006.01) |

(52) U.S. Cl.

CPC ..... *E02F 3/382* (2013.01); *E02F 3/302* (2013.01); *E02F 3/32* (2013.01); *E02F 3/3414* (2013.01); *E02F 3/358* (2013.01); *E02F 9/16* (2013.01); *E02F 9/163* (2013.01); *E02F 9/166* (2013.01)

(58) Field of Classification Search

CPC ... E02F 3/382; E02F 3/302; E02F 3/32; E02F 9/2012; B66F 9/0759

See application file for complete search history.

(56) References Cited

U.S. PATENT DOCUMENTS

| | | | |
|---|---|---|---|
| 4,596,508 | A | 6/1986 | Kishi |
| 4,808,061 | A | 2/1989 | Cook et al. |
| 7,383,906 | B2 | 6/2008 | Sewell |
| 9,510,522 | B2 | 12/2016 | Yrjana et al. |
| 2004/0040137 | A1 | 3/2004 | Sewell |

(Continued)

FOREIGN PATENT DOCUMENTS

| | | | |
|---|---|---|---|
| EP | 3097771 | 11/2016 | |
| EP | 3097771 A1 * | 11/2016 | ..... B66C 23/42 |
| KR | 100205571 | 7/1999 | |

*Primary Examiner* — Gerald McClain

(57) ABSTRACT

An excavator machine includes an undercarriage assembly including a drive assembly, and a carriage assembly rotatably coupled to the undercarriage assembly and including an operator cab positioned at a front of the carriage assembly. The excavator machine also includes a boom assembly. The boom assembly is coupled to the carriage assembly via two branches, and the branches are coupled to the carriage assembly on opposing sides of the operator cab.

21 Claims, 4 Drawing Sheets

(56) References Cited

U.S. PATENT DOCUMENTS

| | | | | |
|---|---|---|---|---|
| 2010/0072801 | A1* | 3/2010 | Adelsperger | B60N 2/14<br>297/344.21 |
| 2014/0193231 | A1 | 7/2014 | Yrjn et al. | |
| 2014/0225397 | A1* | 8/2014 | Gielda | B60R 21/13<br>296/190.03 |

* cited by examiner

MACHINE WITH A BOOM ASSEMBLY

CROSS-REFERENCE TO RELATED APPLICATIONS

This patent application is a continuation of, and claims the benefit of priority to, U.S. patent application Ser. No. 15/956,324, filed on Apr. 18, 2018, the entirety of which is incorporated herein by reference.

TECHNICAL FIELD

The present disclosure relates generally to a machine with a boom assembly, and more particularly, to a cab and boom configuration for an excavator or digging machine.

BACKGROUND

Digging machines, in particular, hydraulic excavators, are used in a wide variety of construction sites. For example, a user may control the digging machine to operate a bucket at an end of a boom attached to the machine to excavate dirt, rocks, clay, sand, asphalt, cement, etc. In most digging machines, the operator is positioned within an operator cab positioned on a platform above the undercarriage of the digging machine. The operator cab is typically adjacent to the connection of the boom to the platform. As such, the boom may obscure the operator's visibility around the machine and into the excavation site. The operator is also off-center from the boom and the bucket, which may impair the operator's ability to operate the boom and bucket. Other elements of the machine positioned on the platform may interfere with or limit the rotation of the excavator boom and/or the operator cab. Additionally, if the digging machine includes cameras, sensors, or other electronic units that may be used in automated procedures, the electronic units must adjust the calculations or otherwise account for the boom and bucket being off-center from a longitudinal centerline of the machine.

U.S. Pat. No. 9,510,522, issued to Yrjänä et al. on Dec. 6, 2016 ("the '522 patent"), describes a forestry machine with a boom structure that includes a branched or fork-like structure. The boom structure of the '522 patent includes branches on left and right sides of the cab. The cab of the '522 patent is positioned in the longitudinal middle of the work machine, which may improve the visibility of the worksite from the cab. The cab of the '522 patent rotates or pivots with the boom to perform various operations at the worksite. However, the cab of the '522 is positioned in a central position along the longitudinal length of the frame of the machine, which does not rotate with the boom or cab structure. The cab and boom of the '522 may not provide for sufficient operator visibility and maneuverability for some applications. The cab and boom configurations of the present disclosure may solve one or more of the problems set forth above and/or other problems in the art. The scope of the current disclosure, however, is defined by the attached claims, and not by the ability to solve any specific problem.

SUMMARY

In one aspect, an excavator machine may include an undercarriage assembly including a drive assembly, and a carriage assembly rotatably coupled to the undercarriage assembly and including an operator cab positioned at a front of the carriage assembly. The excavator machine may also include a boom assembly. The boom assembly may be coupled to the carriage assembly via two branches, and the branches may be coupled to the carriage assembly on opposing sides of the operator cab.

The branches of the boom assembly may be connected by a connection member, and the connection member may extend perpendicular to the branches. A boom may extend from the connection member. The connection member may be a torque tube. The branches of the boom assembly may be coupled to the carriage assembly at respective boom pivots, and the boom pivots may be mounted on the carriage assembly on the sides of a rear portion of the operator cab. The operator cab may include a seat, and the seat may be positioned at a position forward of the boom pivots.

The carriage assembly may include a platform rotatably coupled to the undercarriage assembly via a plate, and rotating the platform may rotate the boom assembly relative to the undercarriage assembly. The operator cab may include a seat, and at least a portion of the seat may be positioned forward of the plate. The seat may be rotatable, and the seat may be selectively positionable in a plurality of positions within the cab via a detent mechanism. The detent mechanism may include a plurality of indentations in a floor of the cab, and the indentations may be positioned in a track. The track may be at least partially circular. The excavator machine may further include a rod coupled to the seat. The rod may include a handle, and the handle may be controllable to selectively position the rod in one of the plurality of indentations in order to temporarily fix a position of the seat. The plurality of indentations may include a forward indentation in a forward position of the track and a rear indentation in a rear position of the track. The plurality of indentations may include an angled indentation approximately 15 to 30 degrees from the forward indentation along the track. The excavator machine may include a driving mode, and the driving mode may include (a) positioning the carriage assembly at an angle relative to a direction of travel of tracks and (b) positioning the rod in the angled indentation in the detent track. The cab may include a door located at a rear portion of the operator cab. The cab may include a plurality of windows forming a seven-sided cab, and the cab may further include a rear support positioned behind the seat.

In another aspect, an excavator machine may include an undercarriage assembly including a drive assembly, a rotatable carriage assembly including a platform and a cab, and a boom assembly including two branches. The two branches may be coupled to the carriage assembly. The cab may be positioned at a front of the platform. The platform may be rotatable relative to the undercarriage assembly via a plate, and rotation of the platform may rotate the cab and the boom assembly.

The excavator machine may further include a seat in the cab, and the seat may be positioned at least partially forward of the plate. The seat may be rotatable and may be selectively positionable in a plurality of positions within the cab via a detent mechanism that includes a plurality of indentations in a floor of the cab to receive a rod. The rod may be coupled to the seat and may be biased toward the floor of the cab.

In a further aspect, an excavator machine may include a rotatable carriage assembly including a platform, a sensor unit, and a boom assembly. The boom assembly may be coupled to the carriage assembly via two branches coupled to the platform on sides of the sensor unit. The boom assembly may be rotatable with the carriage assembly. The sensor unit may be positioned at a front of the carriage assembly and may be coupled to a controller to assist in autonomously operating at least a portion of the excavator machine based on information received from the sensor unit.

The sensor unit may form a forward-most and central portion of the carriage assembly.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus.

For the purpose of this disclosure, the term "ground surface" is broadly used to refer to all types of material that is excavated (e.g., dirt, rocks, clay, sand, asphalt, cement, etc.). In this disclosure, relative terms, such as, for example, "about," substantially," and "approximately" are used to indicate a possible variation of ±10% in the stated value. Although the current disclosure is described with reference to an excavator, this is only exemplary. In general, the current disclosure can be applied as to any machine, such as, for example, a material handler, forest machine, or another boom-operating machine. Further, the present disclosure can be used with work tools other than buckets.

Figure 1:
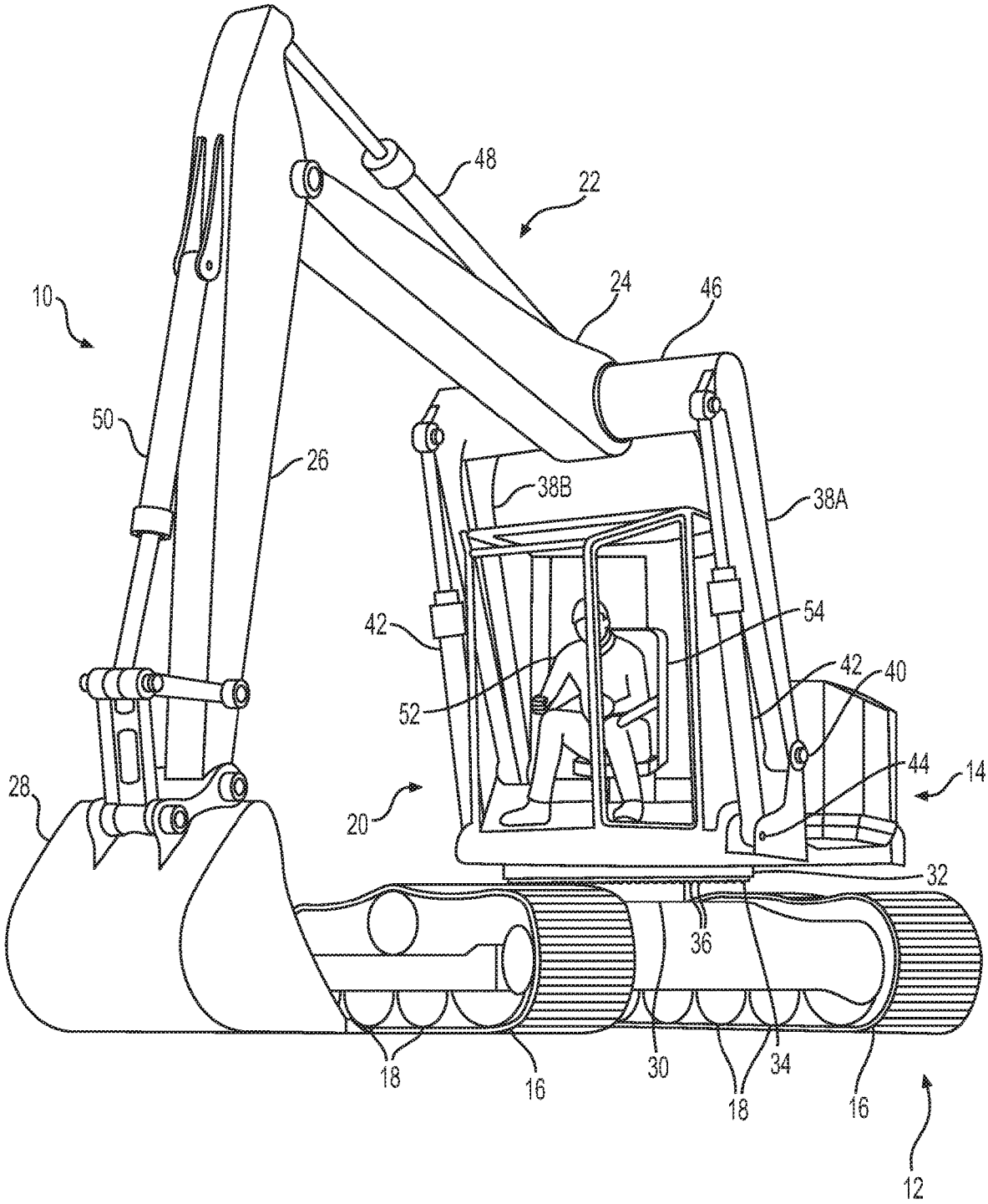
FIG. 1 is an illustration of an exemplary machine of the present disclosure.
Figure 2:
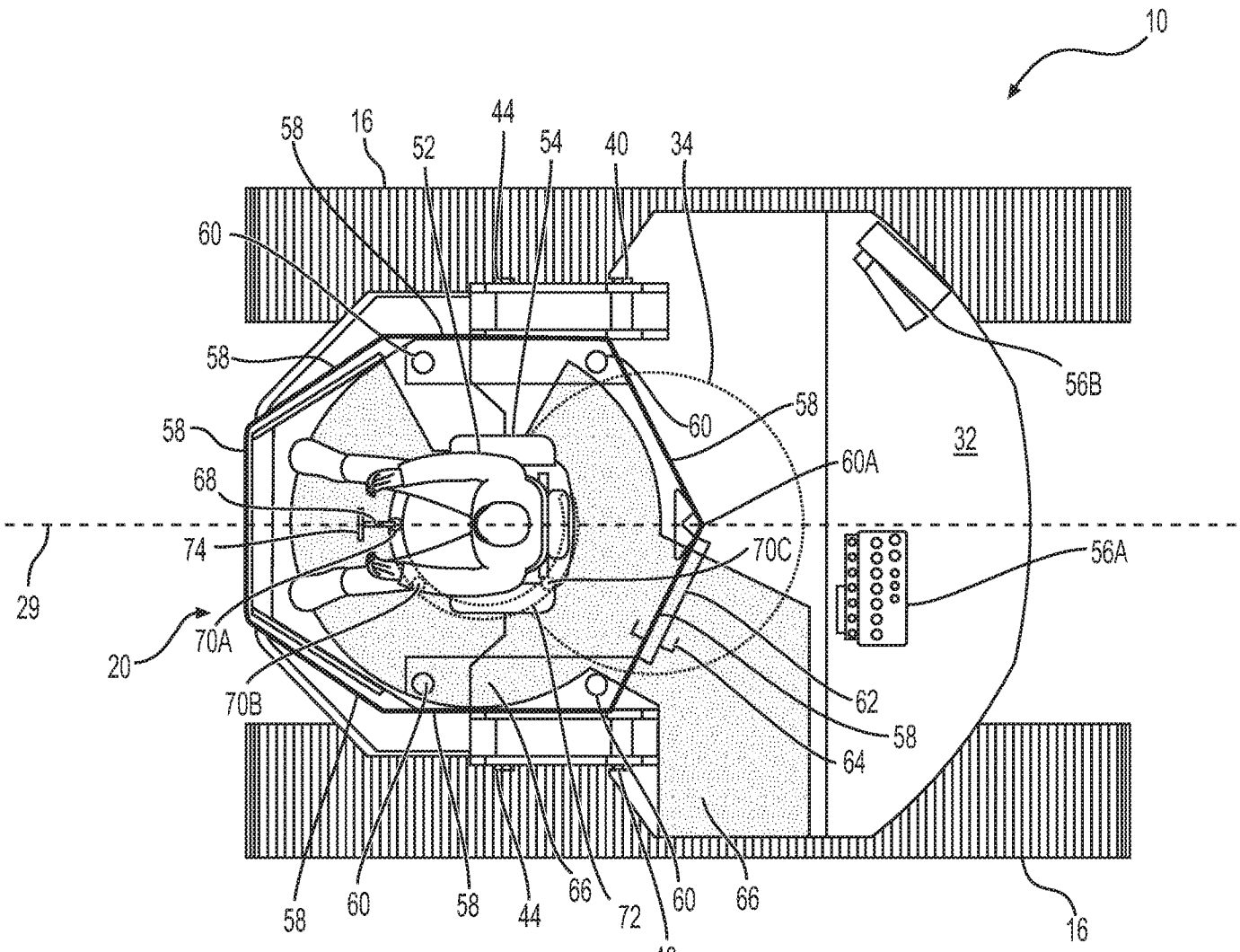
FIG. 2 is an illustration of a top view of a portion of the machine of FIG. 1.

FIG. 1 illustrates a perspective view of an exemplary excavator or machine 10, according to the present disclosure. Machine 10 includes an undercarriage assembly 12 and an carriage assembly 14. Undercarriage assembly 12 may include a drive assembly, for example, tracks 16, along with one or more drive wheels (not shown) and idlers 18 to drive tracks 16. Carriage assembly 14 includes a control station, for example, operator cab 20, to control a boom assembly 22 and operate machine 10. Boom assembly 22 may include a boom 24, a stick 26, and a bucket 28. Boom 24 may be coupled to carriage assembly 14 on opposing sides of cab 20. As shown in FIG. 2, cab 20 is substantially aligned with a centerline or longitudinal axis 29 of machine 10 and with boom assembly 22.

In one aspect, undercarriage assembly 12 includes a carriage mount 30 between tracks 16. Carriage mount 30 may rotatably or pivotably support carriage assembly 14. Although not shown, undercarriage assembly 12 includes a motor or engine to power the drive wheels to drive tracks 16.

Carriage assembly 14 includes a platform 32 pivotably coupled to carriage mount 30. In one aspect, a plate 34 may be fixedly coupled to a bottom portion of platform 32. Plate 34 may include a ring of teeth or ridges 36 extending downward and positioned around a radial exterior. Ridges 36 may be engageable with a toothed gear, cogwheel, or other rotatable element in order to rotate plate 34 and, thus, platform 32. The rotatable element may be powered by a motor (not shown) and controllable by a control element within cab 20 in order to rotate carriage assembly 14 360 degrees relative to undercarriage assembly 12. Moreover, as shown in FIG. 1, cab 20 may be positioned in a central, front position of platform 32. For example, cab 20 may be positioned at a front of platform 32 and be substantially in line with the longitudinal axis 29 of carriage assembly 14, which is parallel to tracks 16 when cab 20 is facing forward. As used herein, positioned at a front of platform 32 or carriage assembly 14 means positioned on or extending to a forward-most position on platform 32 or carriage assembly 14.

Boom assembly 22 is a split boom assembly. In particular, boom 24 may be coupled to two boom branches 38A and 38B, and boom branches 38A, 38B may be coupled to platform 32 via boom pivots 40 on either side of cab 20. Boom branches 38A, 38B are each movable via at least one boom actuator 42, for example, hydraulic cylinders. Boom actuators 42 may each be coupled to platform 32 via a boom actuator pivot 44, which may be mounted on either side of platform 32 beneath and forward of boom pivots 40. Boom branches 38A, 38B extend parallel to each other in planes parallel to boom assembly 22, and are connected by a transversely extending connection member 46. Connection member 46 may be a torque tube, which may help to increase the lifting or excavating capabilities of boom assembly 22. Boom branches 38A, 38B and connection member 46 may be controllable to position boom assembly 22 and bucket 28. Boom 24 is fixedly connected to and extends from a central portion of connection member 46 in a plane parallel to boom branches 38A, 38B. Boom branches 38A, 38B, connection member 46, and boom 24 may be integrally formed or fixedly connected.

Although boom branches 38A, 38B, connection member 46, and boom 24 are shown as unitary members, this disclose is not so limited. Boom branches 38A, 38B, connection member 46, and boom 24 may include different shapes and connections. For example, each of boom branches 38A, 38B may be formed as two separated members, merging together at a common location proximate boom pivots 40 and connection member 46. Alternatively or additionally, boom branches 38A, 38B may be angled toward the longitudinal centerline of carriage assembly in respective portions of boom branches 38A, 38B that would not interfere with cab 20.

Boom assembly 22 is connected to stick 26, and stick 26 is coupled to bucket 28. Stick 26 may be movable via one or more stick actuators 48, for example, hydraulic cylinders. Stick actuator 48 may extend between a proximal portion of stick 26 and boom 24 to control a movement of stick 26. Bucket 28 may be pivotably coupled to stick 26, and movement of bucket 28 may be controlled by one or more bucket actuators 50, for example, hydraulic cylinders extending from a rear portion of stick 26 to linkages of bucket 28.

Figure 3:
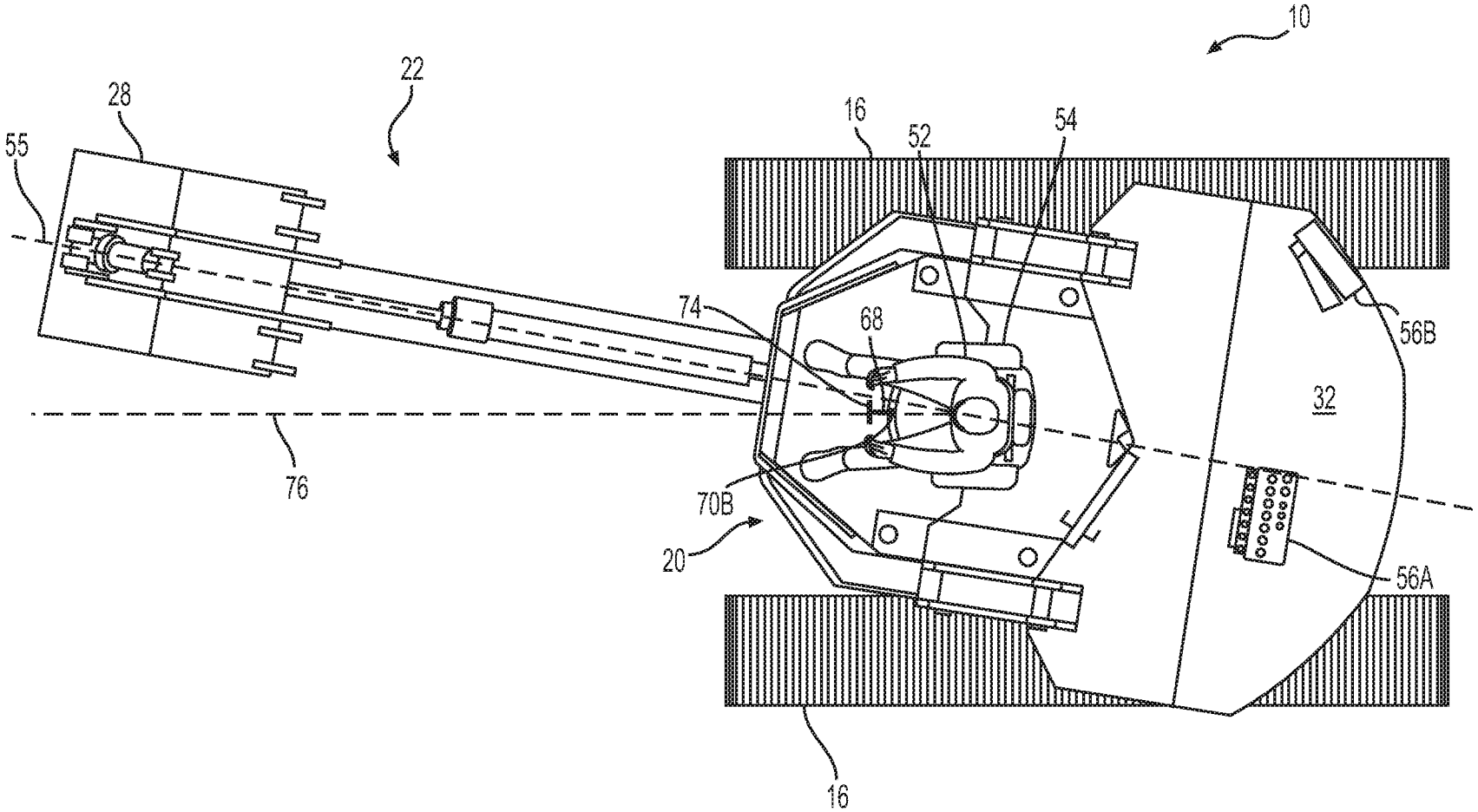
FIG. 3 is an additional top view of a portion of the machine of FIG. 1 in an operational configuration.

It is noted that, although not shown, machine 10 may also include a plurality of tubes or wires to fluidly or electrically connect various components of machine 10. For example, machine 10 may include a plurality of hydraulic fluid lines to fluidly couple a hydraulic fluid source to boom actuators 42, stick actuator 48, bucket actuator 50, etc. Furthermore, cab 20 may include a plurality of controls to operate boom actuators 42, stick actuators 48, and bucket actuators 50, as well as a steering wheel, throttle element, etc. to control undercarriage assembly 12. As such, an operator 52 positioned in a seat 54 within cab 20 may drive and operate machine 10 from a position in line with a centerline 55 of boom assembly 22 (FIG. 3). Although not shown, cab 20 may include one or more exterior lights that may illuminate the area around machine 10, the ground surface, and/or the excavation site, which may help to improve the visibility of operator 52.

FIG. 2 is a top view of a portion of machine 10, with boom assembly 22 omitted for clarity. As shown, cab 20 may be positioned at a front of carriage assembly 14, for example, at a position at least partially forward of plate 34 and/or having a forward portion aligned with the front of tracks 16. Cab 20 may be positioned on a front portion of platform 32, with an operator position or seat 54 positioned in front of or forward of a forward portion of plate 34. Additionally, as shown in FIG. 2, a portion of cab 20 may extend forward of platform 32. For example, platform 32 may extend to boom pivots 40, with a portion of cab 20 extending forward of boom pivots 40. Seat 54 may also be positioned at least partially forward of platform 32, and cab 20 may also extend forward of platform 32. As shown in FIG. 2, seat 54 may extend forward of boom pivots 40 and boom actuator pivots 44. Cab 20 may be fixedly mounted on platform 32 such that cab 20 rotates with platform 32, for example, to position boom assembly 22 (FIG. 3). Platform 32, and thus cab 20, may be fully rotatable 360 degrees relative to tracks 16 and the other components of undercarriage assembly 12. Platform 32 may include one or more component panels 56A, 56B, including, for example, electrical or mechanical components that may be accessed during the operation and/or maintenance of machine 10. Component panels 56A, 56B may be positioned on platform 32 to the rear of cab 20, and may be accessible to an operator with platform 32 and cab 20 in any angle or position relative to tracks 16.

A front portion of cab 20 may be approximately even with or in line with the front of tracks 16. Alternatively, at least a portion of cab 20 may be positioned forward of the front of tracks 16, such that a portion of cab 20 is the forward-most element of machine 10 except for portions of boom assembly 22. Boom pivots 40 may be coupled to platform 32 on a left and right side of cab 20, such that cab 20 is positioned between boom branches 38 (FIG. 1). Additionally, as shown in FIG. 2, cab 20 may be seven-sided, as shown by the thicker lines of FIG. 2. Alternatively, cab 20 may be rectangular, hexagonal, octagonal, or another appropriate shape. Cab 20 may include a plurality of windows 58 such that the operator 52 may view the excavation site. Windows 58 may extend a majority of the height of cab 20 (FIG. 1), or may extend over only a portion of the height of cab 20. Windows 58 may be formed of tempered glass, fiberglass, or another appropriate material. Windows 58 may be supported by a plurality of supports 60. In one aspect, cab 20 may be supported by five supports 60, with a main support 60A positioned to the rear of seat 54. Main support 60A may be larger and/or bear more weight of cab 20 than the other supports 60.

One of windows 58 may form a door 62 with door handles 64 to allow operator 52 to enter and exit cab 20. As shown in FIG. 2, a window 58 to the rear of seat 54 may include door 62. Additionally, seat 54 may be rotatable in order to form an operator path indicated by shaded area 66. For example, operator path 66 may include a portion of platform 32 from a side of platform 32 to cab 20. Operator path 66 may include the opening or door 62 to the rear of seat 54, as well as the range of motion of seat 54. As such, operator 52 may enter and exit cab 20 in a safe manner without climbing onto machine 10 from a position in front of tracks 16, and without traveling underneath boom assembly 22.

Seat 54 may be pivotable and may be lockably positioned within various positions. For example, seat 54 may include a detent mechanism to temporarily lock the position of seat 54. In one aspect, seat 54 includes a rod 68 that extends towards the floor of cab 20. In this aspect, the floor of cab 20 includes a plurality of holes or indentations 70A, 70B, and 70C arranged at least partially circularly to form a detent track 72. Rod 68 may be selectively positionable within the indentations 70A, 70B, and 70C to allow operator 52 to selectively lock seat 54 in various positions. Rod 68 may include a spring or other biasing element to bias rod 68 toward the floor of cab 20, and may also include a handle 74 such that operator 52 may grasp handle 74 and lift rod 68 to remove rod 68 from one of indentations 70A, 70B, and 70C and reposition seat 54.

FIG. 2 illustrates seat 54 positioned in a forward facing position, with rod 68 positioned in indentation 70A. Indentation 70B may be located, for example, approximately 15 to 30 degrees counterclockwise from forward indentation 70A, which may allow an operator to face forward when cab 20 is angled (FIG. 3). Detent track 72 may further include one or more rear indentations 70C, which may be used to lockably position seat 54 facing or near the rear of cab 20, for example, when operator 52 is entering or exiting cab 20 through door 62. While FIG. 2 shows three indentations 70A, 70B, and 70C, this disclosure is not so limited, as the detent mechanism may include any number of indentations in detent track 72 to allow operator 52 to position seat 54 in any number of positions within cab 20.

FIG. 3 illustrates machine 10 in a driving mode. As shown, boom assembly 22 and bucket 28 may be positioned at an angle relative to the centerline of machine 10 by rotating platform 32 at an angle relative to undercarriage assembly 12 and tracks 16. In one aspect, platform 32 may be positioned at an angle of approximately 15 to 30 degrees clockwise relative to tracks 16. It is noted that while FIG. 3 illustrates a portion of boom assembly 22 and bucket 28, FIG. 3 omits stick 26, boom branches 38, and connection member 46 for clarity.

FIG. 3 also illustrates operator 52 with seat 54 positioned in an angled position. As mentioned, seat 54 may be lockably positioned in the angled position by positioning rod 68 in indentation 70B of detent track 72. When seat 54 is secured in this position, operator 52 may have a less obstructed line of sight 76 substantially parallel to tracks 16 and the direction of travel of machine 10. Such a line of sight 76 is helpful when machine 10 is in the driving mode. Once operator 52 has driven machine 10 to the desired site, operator 52 may lift handle 74 and reposition rod 68 in a different indentation (i.e., indentation 70A or 70C) in order to operate boom assembly 22 and bucket 28 or to exit cab 20. Furthermore, detent track 72 may include additional indentations, which may correspond to particular operations of machine 10. For example, although not shown, detect track 72 may include an additional indentation approximately 15 to 30 degrees from 70A in an opposite (clockwise) direction to indentation 70B such that operator 52 may drive machine 10 with boom assembly 22 and bucket 28 positioned at an angle to the operator's left.

Figure 4:
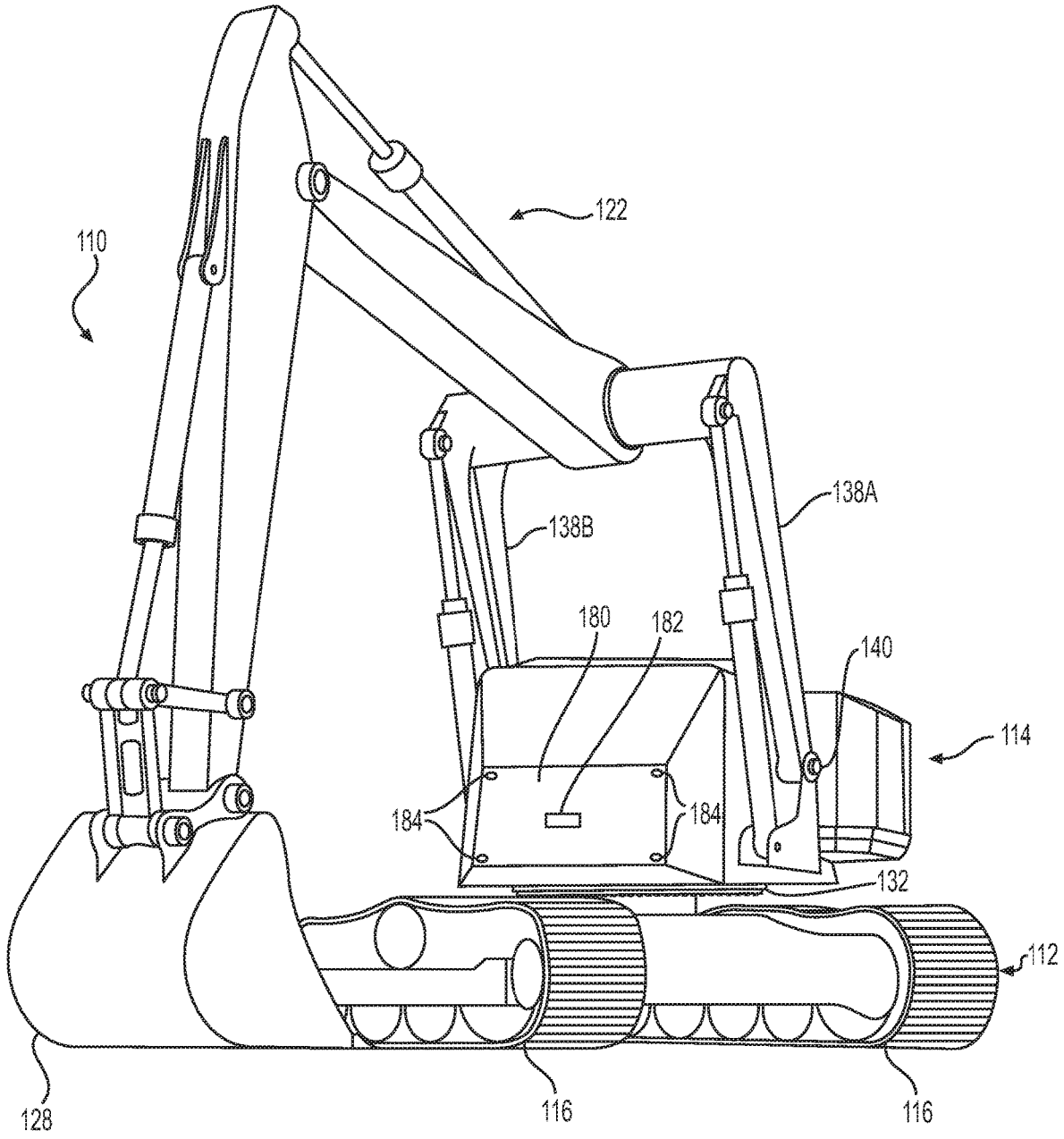
FIG. 4 is an illustration of an alternative exemplary machine of the present disclosure.

FIG. 4 illustrates an alternative example of machine 10 according to the present disclosure, with similar elements of machine 10 shown by 100 added to the reference numbers. Machine 110 includes an undercarriage assembly 112 and a carriage assembly 114. In one aspect, machine 110 may be a cab-less design with automated drive, excavation, and other capabilities. Carriage assembly 114 may include a sensor unit 180 mounted on platform 132 in place of a cab.

Machine 110 includes a split boom assembly 122 with boom branches 138A, 138B coupled to boom pivots 140 to the sides of sensor unit 180.

Sensor unit 180 may include a plurality of cameras, laser elements, or other types of optical elements or sensors. In one aspect, sensor unit 180 may include a central sensor 182 positioned in a center portion of sensor unit 180 on a front of machine 110. Central sensor 182 may be positioned beneath boom 124, and may be aligned with a central longitudinal axis of carriage assembly 114. Sensor unit 180 may also include a plurality of peripheral sensors 184. For example, sensor unit 180 may include four peripheral sensors 184 positioned on sides of sensors unit 180. Although not shown, machine 110 may also include one or more sensors or sets of sensors on the sides or rear of carriage assembly 114. Each of central sensor 182 and peripheral sensors 184 may be electrically connected to one or more controllers (not shown) within sensor unit 180, within carriage assembly 114, or otherwise a part of machine 110. Based on the information received from at least one of central sensor 182 and peripheral sensors 184, the one or more controllers may adjust and operate boom assembly 122 and bucket 128 to conduct an excavation procedure or otherwise move machine 110. Alternatively or additionally, machine 110 may be wired or wirelessly connected to one or more user interfaces (not shown), which may allow a user to view information obtained by at least one of central sensor 182 and peripheral sensors 184 and/or remotely operate machine 110.

INDUSTRIAL APPLICABILITY

The disclosed aspects of machine 10 may be used in any machine where operator vision or maneuverability is important. The disclosed machine may include a cab 20 and a split boom assembly 22. Cab 20 may be centered on the front of platform 32 and thus at the front and center of carriage assembly 14, positioning cab 20 closer to the ground surface. Since boom assembly 22 is aligned with a central longitudinal axis of carriage assembly 14, machine 10 may be capable of excavating loads, with the load being distributed in a balanced manner throughout machine 10. Additionally, connection member 46, which may be a torque tube, may further help to distribute forces on machine 10 when excavating.

Based on the position of cab 20, operator 52 may have visibility around machine 10, the ground surface, and/or of the excavation site. For example, seat 54, and thus operator 52, may be aligned with boom assembly 22 and bucket 28, which may help operator 52 to view the excavation site and the action of boom assembly 22 and bucket 28 during the excavation procedure. Operator 52 may view around machine 10 and the side walls of the excavation trench without boom assembly 22 substantially impairing the operator's sight lines, as seat 52 is at least partially positioned forward of boom pivots 40 and boom actuator pivots 44. With cab 20 being centrally positioned and with boom assembly 22, including a split boom with boom branches 38A, 38B coupled to carriage assembly 14 on sides of cab 20, the space inside cab 20 may allow for ease of operator movement within cab 20. Carriage assembly 14 and boom assembly 22 may also be full rotatable, for example, 360 degrees, relative to tracks 16 and undercarriage assembly 12.

Additionally, as noted above, seat 54 may be selectively positionable in a plurality of different positions. As shown in FIGS. 2 and 3, cab 20 includes detent track 72 with a plurality of indentations 70A, 70B, and 70C into which rod 68 may be releasably positioned to secure seat 54 in a desired position. As such, operator 52 may selectively position the direction of seat 54, which may aid in the operator's entry into and exit from cab 20 via operator path 66. Such an access path to cab 20 being in the rear of cab 20 may help minimize risks to operator 52 while entering and exiting cab 20, as operator 52 does not need to climb aboard machine 10 from the front or back of machine 10 or from beneath boom assembly 22. Furthermore, as shown in FIGS. 2 and 3, indentation 70B may allow operator 52 to position seat 54 in an angled position, which may allow operator 52 a line of sight 76 in a direction of travel of machine 10 when platform 32, along with boom assembly 22 and bucket 28, is angled relative to undercarriage 12. Accordingly, operator 52 may operate machine 10 while driving without interference from boom assembly 22 or bucket 28, and without turning his or her head or body to look in the direction of travel.

As shown in FIG. 4, boom assembly 122 may also assist various capabilities of machine 110. For example, boom assembly 122 may assist with a machine 110 configured to include sensor unit 180 on a front of a cab-less carriage assembly 114 and between boom branches 138A, 138B of boom assembly 122. Sensor unit 180 may provide the necessary sensor capabilities to perform autonomous operations, which may in turn decrease the likelihood of accidents and injuries since an operator need not be positioned on machine 110, and sensor unit 180 may decrease the likelihood of operator errors. The position of sensor unit 180, which may include central sensor 182 and a plurality of peripheral sensors 184, may increase the detection and sensing range of sensor unit 180, for example, obtaining information about the area around machine 110, the ground surface, and/or the excavation site. Moreover, the position of sensor unit 180, that is, aligned with a central axis or centerline 29 (FIG. 2) of carriage assembly 114 and aligned with boom assembly 122 and bucket 128 may reduce the complexity of calculations for the automated system or one or more controllers operating machine 110. For example, the automated system or the one or more controllers need not account for the one or more sensors being mounted on a side of machine 110, and boom assembly 122 being mounted on an opposing side of machine 110. Therefore, sensor unit 180 and the positioning of the one or more sensors 182, 184 relative to boom assembly 122 may allow for quicker and more efficient calculations and/or control of machine 110, including, for example, tracks 116, boom assembly 122, and bucket 128. In this example, machine 110 may be partially or fully autonomous and/or may be controlled via a remote user interface, with the aforementioned increases in safety, visibility, maneuverability, etc.

It will be apparent to those skilled in the art that various modifications and variations can be made to the disclosed system without departing from the scope of the disclosure. Other embodiments of the system will be apparent to those skilled in the art from consideration of the specification and practice of the machine with a boom assembly disclosed herein. It is intended that the specification and examples be considered as exemplary only, with a true scope of the disclosure being indicated by the following claims and their equivalents.

What is claimed is:

1. An excavator machine, comprising:

an undercarriage assembly including a drive assembly;

a carriage assembly rotatably coupled to the undercarriage assembly and including an operator cab positioned at a front of the carriage assembly; and a boom assembly, wherein the boom assembly includes a boom and couples a bucket to the carriage assembly, wherein the boom assembly is coupled to the carriage assembly via two branches, and wherein the branches are coupled to the carriage assembly on opposing sides of the operator cab, wherein the branches of the boom assembly are connected by a connection member, and wherein a boom at least partially surrounds a portion of the connection member.

2. The excavator machine of claim 1, wherein the connection member extends perpendicular to the branches, and wherein the boom extends perpendicularly from the connection member.

3. The excavator machine of claim 2, wherein the connection member is a torque tube.

4. The excavator machine of claim 2, wherein the branches of the boom assembly are coupled to the carriage assembly at respective boom pivots, and wherein the boom pivots are mounted on the carriage assembly on the sides of a rear portion of the operator cab.

5. The excavator machine of claim 4, wherein the operator cab includes a seat, and wherein the seat is positioned at a position forward of the boom pivots.

6. The excavator machine of claim 1, wherein the carriage assembly includes a platform rotatably coupled to the undercarriage assembly via a plate, and wherein rotating the platform rotates the boom assembly relative to the undercarriage assembly.

7. The excavator machine of claim 6, wherein the operator cab includes a seat, and wherein at least a portion of the seat is positioned forward of the plate.

8. The excavator machine of claim 7, wherein the seat is rotatable, and wherein the seat is selectively positionable in a plurality of positions within the operator cab via a detent mechanism.

9. The excavator machine of claim 8, wherein the detent mechanism includes a plurality of indentations in a floor of the operator cab, wherein the indentations are positioned in a detent track, and wherein the detent track is at least partially circular.

10. The excavator machine of claim 9, further including a rod coupled to the seat, wherein the rod includes a handle, and wherein the handle is controllable to selectively position the rod in one of the plurality of indentations in order to temporarily fix a position of the seat.

11. The excavator machine of claim 10, wherein the plurality of indentations includes a forward indentation in a forward position of the detent track and a rear indentation in a rear position of the detent track, and wherein the plurality of indentations includes an angled indentation approximately 15 to 30 degrees from the forward indentation along the detent track.

12. The excavator machine of claim 11, wherein the excavator machine includes a driving mode, and wherein the driving mode includes (a) positioning the carriage assembly at an angle relative to a direction of travel of tracks and (b) positioning the rod in the angled indentation in the detent track.

13. The excavator machine of claim 7, wherein the operator cab includes a plurality of windows forming a seven-sided operator cab, and wherein the operator cab further includes a rear support positioned behind the seat.

14. The excavator machine of claim 7, wherein the operator cab includes a door located at a rear portion of the operator cab.

15. An excavator machine comprising:

an undercarriage assembly including a drive assembly;

a rotatable carriage assembly including a platform and a cab; and a boom assembly including two branches, wherein the two branches are coupled to the carriage assembly on opposing sides of the cab, wherein the cab is positioned at a front of the platform, wherein the platform is rotatable relative to the undercarriage assembly via a plate, and wherein rotation of the platform rotates both the cab and the boom assembly, wherein the branches of the boom assembly are connected by a connection member, wherein the connection member extends perpendicular to the branches, wherein a boom extends from the connection member, and wherein an attached end of the boom at least partially encapsulates a portion of the connection member.

16. The excavator machine of claim 15, further including a seat in the cab, wherein the seat is positioned at least partially forward of the plate.

17. The excavator machine of claim 16, wherein the seat is rotatable and is selectively positionable in a plurality of positions within the cab via a detent mechanism that includes a plurality of indentations in a floor of the cab to receive a rod, and wherein the rod is coupled to the seat and is biased toward the floor of the cab.

18. An excavator machine, comprising:

an undercarriage assembly including a drive assembly;

a carriage assembly rotatably coupled to the undercarriage assembly and including a platform and an operator cab; and a boom assembly coupling a bucket to the carriage assembly, wherein the operator cab is positioned at a front of the platform, wherein the platform is rotatable relative to the undercarriage assembly via a plate, and wherein rotation of the platform rotates both the operator cab and the boom assembly, wherein the boom assembly is coupled to the carriage assembly via two branches, and wherein the branches are coupled to the carriage assembly on opposing sides of the operator cab, wherein the operator cab includes a seat, wherein at least a portion of the seat is positioned forward of the plate, wherein the cab includes a plurality of windows forming a seven-sided operator cab, and wherein the operator cab further includes a rear support positioned behind the seat, and wherein the branches of the boom assembly are connected by a connection member, wherein the connection member extends perpendicular to the branches, wherein a boom extends from the connection member, and wherein an attached end of the boom at least partially encapsulates a portion of the connection member.

19. The excavator machine of claim 18, wherein the seat is rotatable, and wherein the seat is selectively positionable in a plurality of positions within the operator cab via a detent mechanism, wherein the detent mechanism includes a plurality of indentations in a floor of the operator cab, wherein the indentations are positioned in a detent track, and wherein the detent track is at least partially circular, wherein the plurality of indentations includes a forward indentation in a forward position of the detent track, a rear indentation in a rear position of the detent track, and an angled indentation approximately 15 to 30 degrees from the forward indentation along the detent track.

20. An excavator machine comprising:

a rotatable carriage assembly including a platform and a sensor unit; and a boom assembly, wherein the boom assembly is coupled to the carriage assembly via two branches coupled to the platform on opposing sides of the sensor unit, and wherein the boom assembly is rotatable with the carriage assembly, wherein the sensor unit is positioned at a front of the carriage assembly and is coupled to a controller to assist in autonomously operating at least a portion of the excavator machine based on information received from the sensor unit, and wherein the branches of the boom assembly are connected by a connection member, wherein the connection member extends perpendicular to the branches, wherein a boom extends from the connection member, and wherein an attached end of the boom at least partially encapsulates a portion of the connection member.

21. The excavator machine of claim 20, wherein the sensor unit forms a forward most and central portion of the carriage assembly.

* * * * *